United States Patent [19]

Clough

[11] 4,126,353

[45] Nov. 21, 1978

[54] CHAIR TO ROCKING CHAIR CONVERSION UNIT

[76] Inventor: Herbert P. Clough, 5632 Johnnycake Rd., Baltimore, Md.

[21] Appl. No.: 747,606

[22] Filed: Dec. 6, 1976

[51] Int. Cl.[2] ..... A47C 13/00

[52] U.S. Cl. ..... 297/133; 297/272

[58] Field of Search ..... 297/133, 131–132, 297/33, 272, 270

[56] References Cited

U.S. PATENT DOCUMENTS

| | | | |
|---|---|---|---|
| 244,104 | 7/1881 | Andrews | 297/133 |
| 304,435 | 9/1884 | Malick | 297/133 |
| 346,560 | 8/1886 | Punches | 297/133 |
| 405,919 | 6/1889 | Straus et al. | 297/133 |
| 406,400 | 7/1889 | Jacoby | 297/133 |
| 516,549 | 3/1894 | McIlvried | 297/272 |
| 888,224 | 5/1908 | Clemons | 297/272 |
| 1,231,151 | 6/1917 | Gerrard, Jr. | 297/133 |

FOREIGN PATENT DOCUMENTS

| | | | |
|---|---|---|---|
| 1,268,202 | 6/1961 | France | 297/272 |

*Primary Examiner*—Francis K. Zugel
*Attorney, Agent, or Firm*—Walter G. Finch

[57] ABSTRACT

This invention relates to a conversion unit for converting an ordinary standard sitting chair to a rocking chair. The conversion unit is adjustable and as such is adaptable to any type chair. The conversion unit is essentially a rocking frame that attaches to the four legs of the chair with a novel and unique arrangement of connecting pieces and for easy removal when it is desired to convert the rocking chair back to an ordinary chair. From a standpoint of a user this invention might be descriptively referred to as a "Rock-A-Chair".

5 Claims, 8 Drawing Figures

CHAIR TO ROCKING CHAIR CONVERSION UNIT

BACKGROUND AND SUMMARY OF THE INVENTION

In years gone by a rocking chair was a fixture in every home, sometimes more than one rocking chair. In recent times the tendency has been to furnish a home with ordinary or regular chairs and the comfort and pleasure of a rocking chair has become relatively unknown to a large majority of the modern population. This invention will overcome that missing pleasure at a cost far less than the high price of present day rocking chairs.

Conversion units have been invented in the past, but the designs were massive, cumbersome to assemble, had less than adequate flexibility and adaptability, and in today's economy would be beyond an economic consideration for any user. This invention overcomes the deficiencies of the past attempts at converting a chair to a rocking chair.

The invention generally comprises a pair of lightweight rockers, a pair of simple braces, and a set of connecting pieces for each chair leg. The conversion unit can be assembled and attached to the ordinary standard chair for easy removal, or if desired, can be more permanently attached to the legs of the chair.

Accordingly, it is a primary object of the invention to provide a conversion unit for converting an ordinary standard chair to a rocking chair.

It is another object of the invention to provide a conversion unit that is easy to assemble and attach to the chair.

It is a further object of the invention to provide a conversion unit that is just as readily and easily removable from the chair.

Yet another object of the invention to provide a conversion unit that can be attached to a chair in a more permanent manner if desirable.

It is still another object of the invention to provide a conversion unit that is economical to construct and furnish to the public.

Further objects and advantages of the invention will become more apparent in light of the following detailed description of the preferred embodiment of the invention.

BRIEF DESCRIPTION OF THE INVENTION

DESCRIPTION OF THE PREFERRED EMBODIMENT

Figure 1:
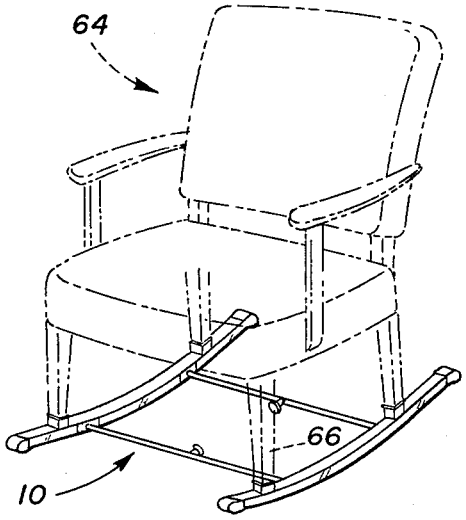
FIG. 1 is an idealized schematic pictorial view illustrating the chair to rocking chair conversion unit assembled and attached to an ordinary chair.

The embodiment of the invention shown in the drawings essentially operates according to the method of the invention, the devices shown being merely illustrative since a variety of other devices, closely similar, could be used in the practice of the invention.

As noted hereinabove, the invention contemplates an easily assembled and attached conversion unit to convert an ordinary standard chair to a rocking chair so that the pleasures of a rocking chair may be enjoyed at an economical expenditure of a minimum of funds. The refined lines of these embodiments are, in themselves, distinct improvements over the crude designs of past inventions.

Referring now to the drawings, it can be seen relative to FIG. 1 that the invention can be configured as a specific rocker assembly device 10 as applied to a typical chair 64. Going now to FIGS. 2 and 3, the structure of the device 10 consists of these three major sub-assemblies: two rocker assemblies 11 and 13, essentially a left rocker assembly 11 and a right rocker assembly 13 as you stand in front of the device 10 on the typical chair 64 in FIG. 1; two similar adjustable brace assemblies 24 and 26, shown as a front brace assembly 24 and a rear brace assembly 26, as viewed from in front of the device 10 on the typical chair 64 in FIG. 1; and four chair leg attachment assemblies 40, 42, 44, and 46 as seen in the plan view in FIG. 2, the chair leg attachment assemblies 44 and 46 being also shown in side elevation in the side view in FIG. 3. The detailed description of the structural piece parts making up these three simple structural sub-assemblies (the rocker assembly at 11 and 13, the adjustable brace assembly at 24 and 26, and the chair leg assembly at 40, 42, 44 and 46) will be described hereinafter.

First, the two rocker assemblies 11 and 13; note that one is a left version rocker assembly 11 and the other is a right version rocker assembly 13, hereinbefore described. The left and right rocker assemblies 11 and 13 respectively are mirror images of each other. The left rocker assembly 11 can be identified from the right rocker assembly 13 by the location on the sides thereof of assembly connection facility for the adjustable brace assemblies 24 and 26 and the relative position of the connection facility in regard to the end safety plugs 16, 18, 20, and 22. It should be noted that end safety plugs 16 and 18 are of a different configuration than end safety plugs 20 and 22. Thus, the front and rear of the total assembly 10 can be identified by the configurations of the end safety plugs 16, 18, 20 and 22. The configuration of end safety plugs 16 and 18 is for the front of the rocker assembly 10 and the configuration of end safety plugs 20 and 22 is for the rear of the rocker assembly 10.

The left rocker assembly 11 consists of: the rocker member 12; the front end safety plug 16; and the rear end safety plug 20. The rocker assembly 13 consists of: the rocker member 14; the front end safety plug 18; and the rear end safety plug 22. Rocker members 12 and 14 are square hollow tubes, but may be rectangular, bent into arc.

Each of the rocker members 12 and 14 has facility for assembly of the adjustable brace assemblies 24 and 26 as aforementioned. Such facility for assembly may be by machine screws in predrilled and taped holes; by self tapping screws in predrilled holes; by external threaded ends on the cylindrical structural parts 28, 30, 32, and 34 of adjustable brace assemblies 24 and 26 fitted into internal threads of drilled holes in the rocker members 12 and 14 respectively. All of these methods being the rigid assembly of adjustable brace assemblies 24 and 26 to the sides of rocker members 12 and 14. These alternate acceptable assembly methods hereinbefore described to not preclude the use of other methods, such as by welding or pinning if so chosen, that accomplishes the same rigid assembly of the aforesaid structural parts. Such other methods of assembly are within the intent and scope of this invention.

Each of the rocker members 12 and 14 is provided with assembly slots 48 at each end of each rocker member, said slots 48 being in the top side or internal side of the arc made by the bend of the rocker members 12 and 14. The said top side being opposite to the bottom side which is identified as that side which is the exterior side of the arc made by the bend of the rocker members 12 and 14 and which said bottom side interfaces with the surface on which the rocker assembly 10 is to operate as viewed in FIG. 1. The said top side is also identified as that side of the rocker members 12 and 14 on which the legs of the typical chair 64 will be assembled as hereinafter described. The assembly slots 48 are of a length to facilitate a range of chair leg spans on typical chairs 64.

The purpose of the end safety plugs 16, 18, 20, and 22 is specifically safety. All of the aforementioned end safety plugs 16, 18, 20 and 22 prevent the accidental scratching or cutting of the hand on sharp edges, scratching, cutting, skewing, or so-called "barking" or abrading parts of the leg when accidentally bumping the ends of the rocker assemblies 11 and 13. Also damaging other furniture, draperies, and such items when accidentally struck by the ends of the said rocker assemblies 11 and 13. In addition, the novel and unique design of the rear end safety plugs 20 and 22 is so made with downward protrusions so as to repel the accidental over-tipping of the rocking chair in a backward direction if unintentionally rocked with excessive vigor, a distinct safety measure in this invention. In addition to the safety aspects, the end safety plugs 16, 18, 20 and 22 add to the beauty of the fine lines of this invention.

Figures 2, 3, 4, 5, 6:
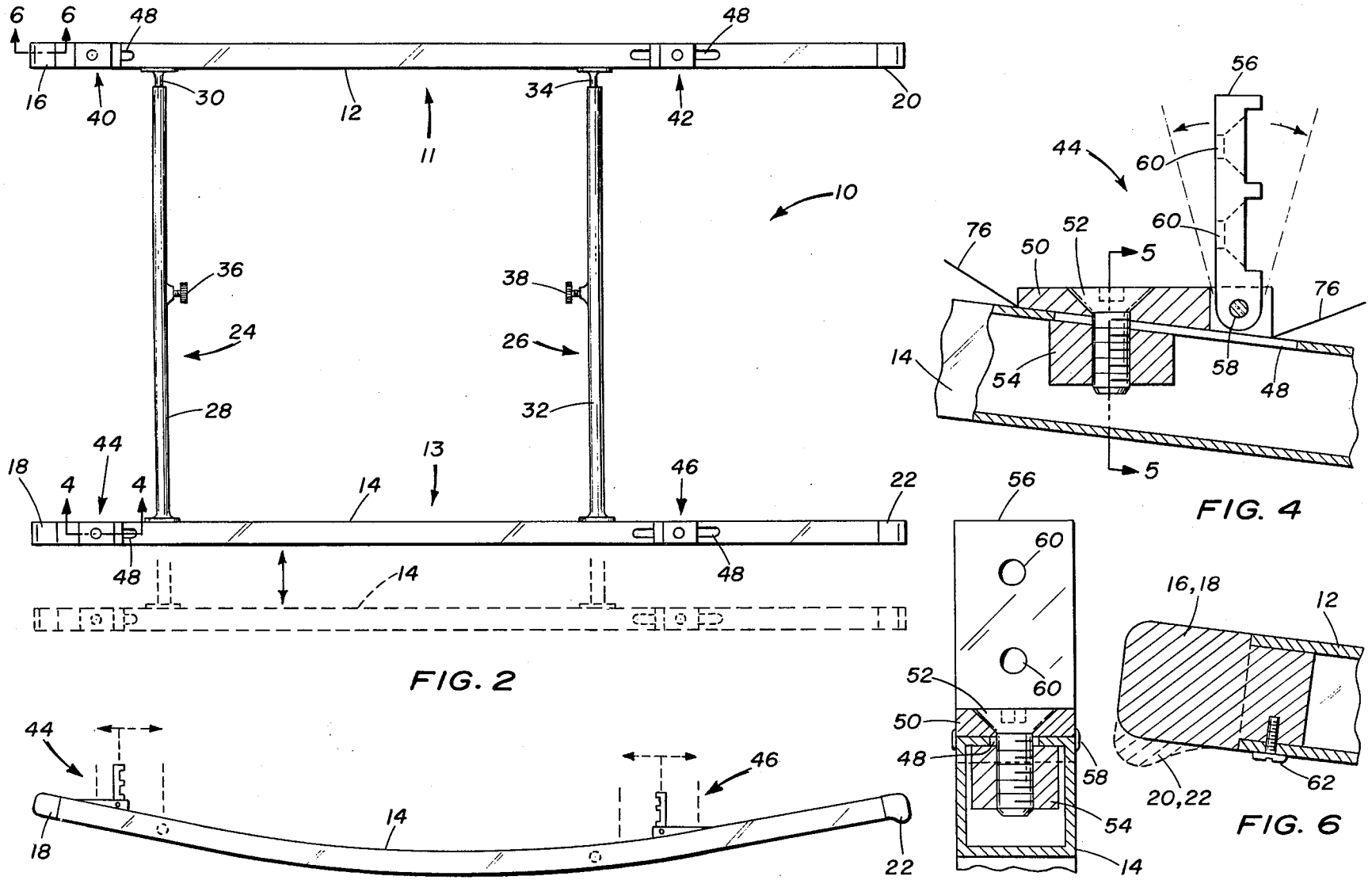
FIG. 2 is a plan view of the conversion unit showing the width adjustment with braces.
FIG. 3 is a sideview of the conversion unit showing the span of adjustment of the connections to chair legs.
FIG. 4 is a cross section view 4—4 of FIG. 2 showing the assembly of the leg connecting piece.
FIG. 5 is a cross section view 5—5 of FIG. 4 showing the detail of the leg connecting piece.
FIG. 6 is a cross section view 6—6 of FIG. 2 showing the safety fitting for the ends of the rockers.

Assembly of the end safety plugs 16, 18, 20, and 22 into the ends of the rocker members 12 and 14 is shown in FIG. 6 which illustrates a typical assembly in an end of rocker member 12 (assembly in rocker member 14 is similar). As shown in FIG. 6, the assembly of the end safety plugs 16, 18, 20 and 22 in the end of rocker members 12 and 14 is made secure by inserting a machine screw 62 in the bottom side (bottom side being as hereinbefore defined). The illustrated use of a machine screw shall not preclude the use of a self tapping screw, pinning, press fit, or tack welding, or any other manner of fastening. Such other methods of securing the end safety plugs are within the intent and scope of this invention.

The two adjustable braces 24 and 26 are alike. The adjustable braces 24 and 26 each consist of: an outer telescoping member 28 and 32 respectively; and inner telescoping member 30 and 34 respectively; and lock-screws 36 and 38 respectively.

The ends of the telescoping members 28, 30, 32, and 34 are illustrated in FIG. 2 as flanged for assembly to the rocker members 12 and 14 as hereinbefore described. As hereinbefore described the said assembly to the rocker members 12 and 14 of rocker assemblies 11 and 13 respectively may be by various methods, all of which are within the intent and scope of this invention.

As noted and described hereinbefore, some of the said assembly methods may be made without the need of a flange, as illustrated in FIG. 2, and such flangeless assembly is within the intent and scope of this invention.

As illustrated in FIG. 2, the inner telescoping members 30 and 34 are shown assembled to rocker member 12 and the outer telescoping members 28 and 32 are shown assembled to rocker member 14. It is within the intent and scope of this invention that the assembly of inner telescoping members 30 and 34 and outer telescoping members 28 and 32 to rocker members 12 and 14 may be made in the reverse direction or order and need not be symetrically assembled (either one or both of the adjustable brace assemblies 24 and 26 may be reversed from the way in which illustrated in FIG. 2 without departing from the intent or scope of the invention).

As illustrated in FIG. 2, the components of adjustable braces 24 and 26 are round. It is to be noted that all shapes are within the intent and scope of this invention (round, square, rectangular, hexagon, or other geometrical configuration). As a single adjustable brace, the brace can be located centrally between the rocker members 12 and 14 and made of a flat telescoping pan-type configuration.

The adjustment of the rocker assembly device 10 to meet the variations in width of the typical chair 64 is accomplished by adjusting the adjustable braces 24 and 26 respectively to accommodate the legs of such typical chair 64. This adjustment range is illustrated in FIG. 2 by the phantom lines for the right rocker assembly 13.

When the position is determined to match the leg positions of the typical chair 64, the lock-screws 36 and 38 are tightened to secure the outer telescoping members 28 and 32 to the inner telescoping members 30 and 34 and thus fix the adjustable braces 24 and 26 into set positions. A knurled thumb screw in a boss is illustrated for the lock-screws 36 and 38. This is not to preclude the use of ordinary set screws, wing nut style screws, or other methods for locking the telescoping members 28 and 30, and 32 and 34, together in fixed positions; such other methods are incidental and within the intent and scope of this invention.

For aesthetic purposes, the illustration in FIG. 2 shows the lock-screw 36 and 38 positioned inwardly so that they appear facing each other. It is within the intent and scope of this invention that these lock-screws 36 and 38 may face in any direction. If assembled by design or manufacture on any part of the outer surface of the outer telescoping members 28 and 32 the lock-screws 36 and 38 might be situated at any point in the 360° circle from the position as illustrated in FIG. 2.

The assembly of the rocker assembly 10 to the legs of a typical chair 64 is accomplished by attaching the chair legs to the chair leg attachment assemblies 40, 42, 44 and 46 in FIGS. 2 and 3.

Figure 8:
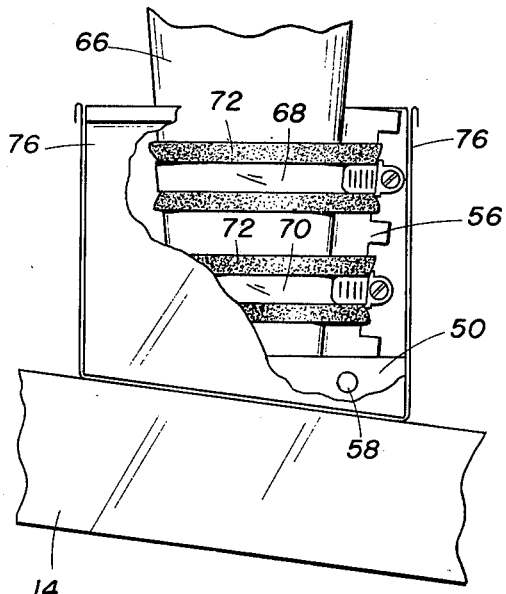
FIG. 8 is a partial sideview of the connection to a chair leg.
Figure 7:
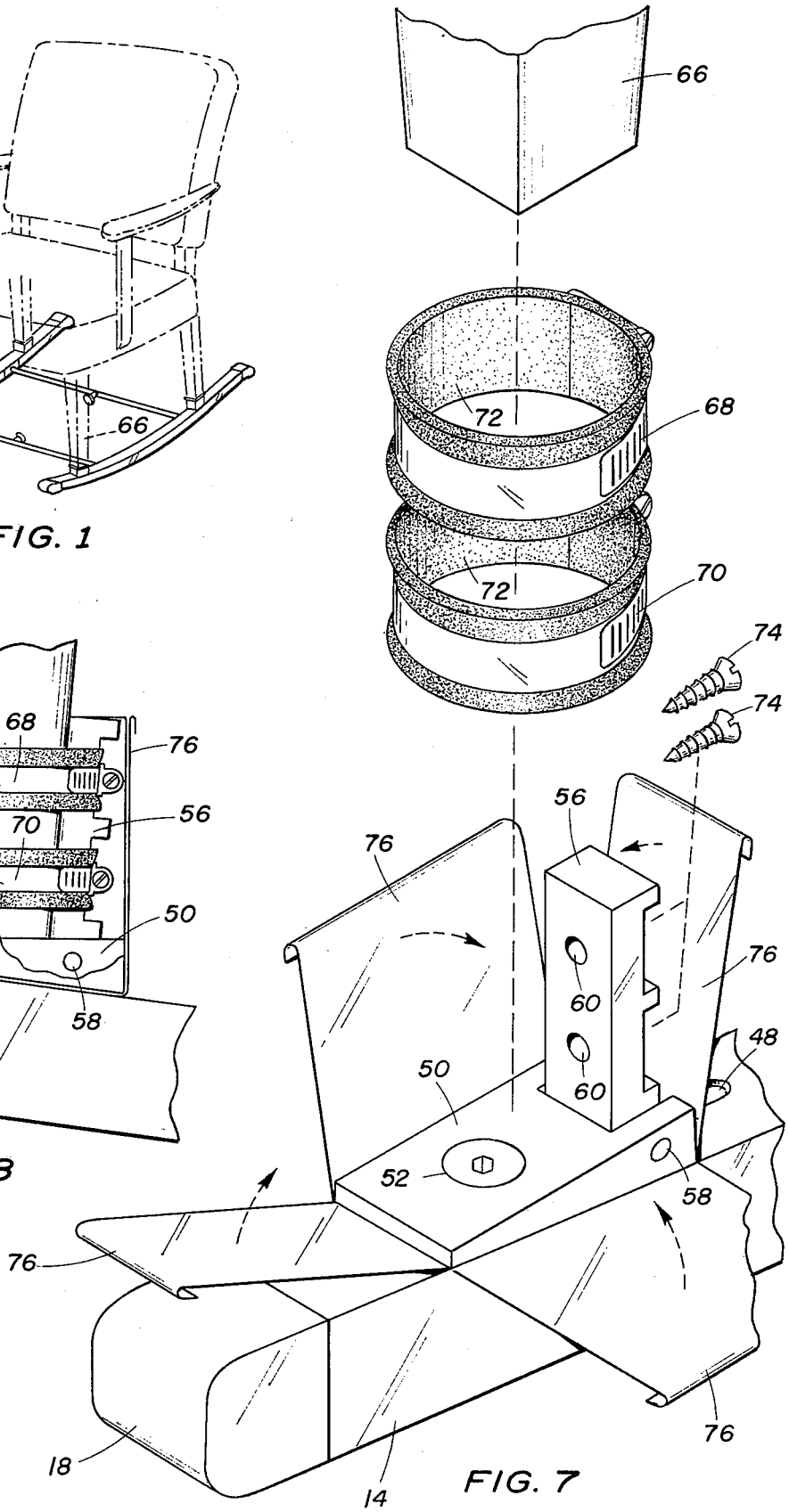
FIG. 7 is an exploded schematic showing the method of attaching the conversion unit to a chair leg.

The chair leg attachment assemblies 40, 42, 44 and 46 each consist of parts as illustrated in FIGS. 4, 5, and 7, and as illustrated assembled in FIG. 8, and as hereinafter described.

The parts of the chair leg attachment assemblies 40, 42, 44, and 46 each consist of the same typical elements now described hereinafter.

Leveling blocks 50 are assembled to the rocker members 12 and 14, two to each said rocker member, by locating them on slots 48 at each end of the said rocker members. The position for each leveling block 50 is located so that when secured in place on the slots 48 the chair legs 66 of a typical chair 64 will rest on the leveling blocks 50. The slope of the surface of the leveling blocks 50 that interfaces with the surface of rocker members 12 and 14, at the slots 48 therein, is such that the opposite surface of the leveling blocks 50 that will interface with the bottom side of the chair legs 66, will essentially be level with respect to the horizontal floor upon which the assembled rocker device 10 will be operated as a rocking chair.

The leveling blocks 50 are secured to the rocker members 12 and 14 by machine screws 52 each engaging a separate nut 54 inside the hollow rocker members 12 and 14.

A hinged attachment bracket 56 is fastened to the inboard end of each leveling block 50 by a pin 58. The inboard end of leveling block 50 is the thickest end as shown in FIGS. 3 and 4 and as such the said inboard ends will be adjacently opposite each other on a typical rocker member 12 or 14. The said inboard end is also provided with the hole for the pin 58. The illustrated pin 58 has a head on one end and may be secured in place by peening over the opposite end as illustrated in FIG. 5; however, the use of cotter pins, washers and nuts, or other methods of providing a pin-type member for the hinged joint is within the intent and scope of this invention. The attachment bracket 56 is hinged to facilitate a close interface with any typical chain leg 66 which may be angled slightly with the vertical. This range of movement for the hinged attachment bracket 56 is shown in FIG. 14 by dash lines.

Each hinged bracket 56 is provided with two slotted recesses across the inboard side (as hereinbefore described as inboard) to accept standard clamps 68 and 70 (FIGS. 7 and 8) as hereinafter described. Within each of those slotted recesses a countersunk hole 60 is provided to accept a screw 74 should the user of this invention desire to make the rocker conversion a permanently fixed assembly. The illustrated screws in FIG. 7 are wood screws for wooden chair legs, however, the use of self-tapping metal screws for metal leg chairs is within the intent and scope of this invention.

After the rocker device 10 is assembled and secured in dimensional position to fit the chair leg configuration, the attachment of the chair to the rocker device 10 is made as follows: protective material 72 is placed around each leg 66 to protect the leg 66 finish when the clamps 68 and 70 are tightened. The protective material 72 may be in one piece or in two pieces as illustrated in FIG. 7. Clamps 68 and 70 are standard clamps. The protective material 72 may be any soft pliable material such as rubber or similar composition.

For aesthetic purposes, a thin metal boot 76 is inserted under the leveling block 50 during assembly. The four sides of the boot 76, being thin, are easily bent up into position around the chair leg 66 to exclude the clamps 68 and 70, protective material 72, and other features of the connection assembly from view. The four sides are retained in vertical position by a wire band (not shown in the illustration) around the four sides and moved up under the turned upper edge or lip of each of the four sides as seen in FIGS. 7 and 8. The thin metal boots 76 are precut, and may be partially preformed, to fit various size chair leg cross-sectional dimensions. It is to be noted that the base portion of boot 76 which is assembled under the leveling block 50 will vary in size according to the cross-sectional area and configuration of the chair leg 66. Therefore, the base portion of boot 76 may extend beyond the edges of leveling block 50. A slot (not shown) is provided in the base portion of boot 76 in a transverse direction to the rocker members 12 and 14 so that a user may offset the chair leg 66 to the inboard sides of rocker members 12 and 14 if a flush assembly is desired on the outboard side of rocker members 12 and 14.

Unless assembled for permanent use, this invention provides for easy disassembly from the rocking chair configuration to a standard chair. In such a disassembly, the disconnection need only be made at the chair legs 66 by opening the metal boot 76, removing the clamps 68 and 70 and the protective material 72. The balance of the assembly can remain in assembled condition for easy and quick installation when next a rocking chair is desired, unless a different chair or different dimensions requires a readjustment of the positions for the leg attachments.

As it has been indicated in various parts of this specification, it should be apparent from the description provided of the embodiment of the invention, that other variations could be employed for the construction of the rocker device without departing from the scope or intent of the invention as defined by the appended claims.

What is claimed is:

1. A structure for converting any standard chair into a rocking chair, the structure comprising:

a pair of spaced arcuate rocking means, each said spaced arcuate rocking means being hollow rectangular tubes of arcuate configuration;

smooth surface plug means inserted in the open ends of said rectangular tubes to obliterate dangerous sharp ends of said spaced rocking means, with the rearward positioned plug means having downwardly positioned protrusions to prevent backward tipping of said standard chair connected to said rocking chair when in motion of backward movement;

at least one adjustable brace rigidly connecting and intermediate the said spaced rocking means;

connecting means for leveling and attaching each leg of the said standard chair to a relative position on one of the said spaced rocking means; and means for enclosing each said connecting means, each connecting means consisting of a leveling member to connect the arcuate top surface of said spaced rocking means to an essentially horizontal plane of the bottom of the legs of said standard chair;

means for attaching the said leveling member to the said arcuate top surface of said spaced rocking means at a plurality of positions;

means for attaching the said variable position attachment member to the said leveling member; and means for attaching the said legs of the said standard chair to the said variable position attachment member.

2. The structure of claim 1 wherein the adjustable brace consists of:

a hollow rod-like first member capable of receiving in one end a second member;

a smaller hollow or solid rod-like second member closely fitting inside the said first member and telescoping therein;

means for connecting the ends of the said first and second members to the said spaced rocking means; and means for locking the said first and second members together in selected positions.

3. The structure of claim 1, wherein a plurality of adjustable braces are provided for rigidly connecting said rocking means and located intermediate of said rocking means.

4. The structure of claim 1 wherein the means for enclosing the connecting means is thin material capable of repositioning around any said connecting means with means for holding the said thin material in said reposition.

5. The structure of claim 1 wherein the said means for attaching the said legs of said standard chair to the said variable position attachment member is of a permanent nature.

* * * * *